US009805651B2

(12) United States Patent
Kim

(10) Patent No.: US 9,805,651 B2
(45) Date of Patent: Oct. 31, 2017

(54) ORGANIC LIGHT EMITTING DISPLAY APPARATUS

(71) Applicant: SAMSUNG DISPLAY CO., LTD., Yongin, Gyeonggi-do (KR)

(72) Inventor: Yang-Wan Kim, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 49 days.

(21) Appl. No.: 14/657,219

(22) Filed: Mar. 13, 2015

(65) Prior Publication Data

US 2015/0364092 A1 Dec. 17, 2015

(30) Foreign Application Priority Data

Jun. 17, 2014 (KR) ..... 10-2014-0073677

(51) Int. Cl.
*G09G 3/32* (2016.01)
*G09G 3/3233* (2016.01)

(52) U.S. Cl.
CPC ... *G09G 3/3233* (2013.01); *G09G 2300/0842* (2013.01); *G09G 2310/0251* (2013.01); *G09G 2310/0262* (2013.01)

(58) Field of Classification Search
CPC ..... G09G 3/3291; G09G 2300/0465; G09G 2300/0819; G09G 3/3225; G09G 2300/0408; G09G 2310/0262; G09G 3/3233; G09G 3/3241
See application file for complete search history.

(56) References Cited

U.S. PATENT DOCUMENTS

2008/0316150 A1* 12/2008 Lee ..... G09G 3/3233 345/76
2013/0009933 A1* 1/2013 Toyomura ..... G09G 3/3225 345/211
2013/0201172 A1 8/2013 Jeong et al.
2013/0286054 A1 10/2013 Kitadani et al.
2014/0022288 A1 1/2014 Tsuge

FOREIGN PATENT DOCUMENTS

KR 10-2013-0091136 8/2013
KR 10-2013-0120402 11/2013
KR 10-2013-0120402 A 12/2013
KR 10-2013-0136554 12/2013

* cited by examiner

*Primary Examiner* — Benjamin C Lee
*Assistant Examiner* — Robert Michaud
(74) *Attorney, Agent, or Firm* — Lee & Morse, P.C.

(57) ABSTRACT

An organic light-emitting display apparatus includes a pixel circuit, a light emitter, an initialization transistor, and a coupling capacitor. The pixel circuit outputs a driving current to a node based on a data signal. The light emitter emits light based on the driving current at the node. The initialization transistor outputs an initial voltage to the node based on a first control signal received through a first control line. The coupling capacitor is between the node and the first control line.

14 Claims, 7 Drawing Sheets

ORGANIC LIGHT EMITTING DISPLAY APPARATUS

CROSS-REFERENCE TO RELATED APPLICATION

Korean Patent Application No. 10-2014-0073677, filed on Jun. 17, 2014, and entitled, "Organic Light Emitting Display Apparatus," is incorporated by reference herein in its entirety.

BACKGROUND

1. Field

One or more embodiments described herein relate to an organic light emitting display apparatus.

2. Description of the Related Art

An organic light emitting display uses sub-pixels to emit light of different colors. Each sub-pixel is driven by a current which flows based on an applied voltage The level of the voltage required for each sub-pixel may differ based on the color of light to be emitted. As a result, the time required for the sub-pixel to emit one color of light may be different from a sub-pixel that emits another color of light. This difference may cause the combined light from a unit pixel to be different from a desired color.

SUMMARY

In accordance with one embodiment, an organic light-emitting display apparatus includes a pixel circuit to output a driving current to a node based on a data signal; a light emitter to emit light based on the driving current at the node; a transistor to output an initial voltage to the node based on a first control signal received through a first control line; and a coupling capacitor between the node and the first control line. The transistor may initialize a potential of the node, and the potential may change in synchronization with an edge of the first control signal by the coupling capacitor. The apparatus includes a first sub-pixel to emit light of a first color, the first sub-pixel including the pixel circuit, the light-emitter, the transistor, and the coupling capacitor; and a second sub-pixel to emit light of a second color different from the first color, the second sub-pixel including a pixel circuit, a light-emitter, and an initialization transistor. The light-emitter of the first sub-pixel may have a threshold voltage different from the light-emitter of the second sub-pixel.

The apparatus may include a plurality of lines connected to the pixel circuit, wherein the plurality of lines may include a driving voltage line to carry a first driving voltage, a data line to carry the data signal, a second control line to carry a second control signal, a third control line to carry a third control signal, and a fourth control line to carry a fourth control signal, and wherein the second control signal, the third control signal, and the first control signal may have active periods in an inactive period of the fourth control signal.

The pixel circuit may include a driving transistor having a first electrode to receive the first driving voltage and a second electrode connected to the node; and a switching transistor having a first electrode to receive a data signal and a second electrode connected to the first electrode of the driving transistor, wherein the driving transistor may supply the driving current corresponding to the data signal to the light-emitter according to a switching operation of the switching transistor.

The pixel circuit may include a gate initialization transistor to supply the initial voltage to a gate electrode of the driving transistor based on the second control signal; a compensation transistor to connect the gate electrode of the driving transistor to the second electrode of the driving transistor based on the third control signal; a first light-emitting control transistor to output the driving current to the node based on the fourth control signal; and a storage capacitor to store a voltage difference between the first driving voltage and a voltage of the gate electrode of the driving transistor.

The gate initialization transistor may include a gate electrode connected to the second control line, a first electrode to receive the initial voltage, and a second electrode connected to the gate electrode of the driving transistor, wherein the compensation transistor may include a gate electrode connected to the third control line, a first electrode connected to the gate electrode of the driving transistor, and a second electrode connected to the second electrode of the driving transistor, and a second light-emitting control transistor may connect the driving transistor and the driving voltage line, wherein the first light-emitting transistor is to connect the driving transistor to the light-emitter.

In accordance with another embodiment, an organic light-emitting display apparatus includes a plurality of first sub-pixels, a plurality of second sub-pixels, and a plurality of third sub-pixels, wherein each of the first through third sub-pixels includes: a pixel circuit to output a driving current to a node based on a data signal; a light-emitter to emit light based on the driving current at the node; and a transistor to output an initial voltage to the node based on a first control signal carried through a first control line, wherein at least one of the first through third sub-pixels includes a coupling capacitor between the node and the first control line.

A potential of the node may be initialized based on the initial voltage from the transistor, the potential changing in synchronization with an edge of the first control signal by the coupling capacitor. The apparatus may include a plurality of lines connected to the pixel circuit, wherein the plurality of lines may include a driving voltage line to carry a first driving voltage, a data line to carry the data signal, a second control line to carry a second control signal, a third control line to carry a third control signal, and a fourth control line to carry a fourth control signal, and wherein the second control signal, the third control signal, and the first control signal may have active periods in an inactive period of the fourth control signal.

The pixel circuit may include a driving transistor having a first electrode to receive the first driving voltage and a second electrode connected to the node; a switching transistor having a first electrode to receive a data signal and a second electrode connected to the first electrode of the driving transistor; a gate initialization transistor to supply the initial voltage to a gate electrode of the driving transistor based on the second control signal; a compensation transistor to connect the gate electrode of the driving transistor to the second electrode of the driving transistor based on the third control signal; a light-emitting control transistor to output the driving current to the node based on the fourth control signal; and a storage capacitor to store a voltage difference between the first driving voltage and a voltage of the gate electrode of the driving transistor.

The driving transistor may supply a driving current corresponding to the data signal to the light-emitter according to a switching operation of the switching transistor. The coupling capacitor may be coupled to the light-emitter, and the light emitter may emit green light In accordance with another embodiment, an organic light-emitting display apparatus a pixel circuit to output a driving current to a node based on a data signal; a light-emitter to emit light based on the driving current at the node; and a transistor to output an initial voltage to the node based on a first control signal through a first control line, wherein: a coupling capacitance is between the node and the first control line, and a potential of the node changes in synchronization with an edge of the first control signal.

The apparatus may include a coupling capacitor between the node and the first control line, the coupling capacitor having the coupling capacitance. The apparatus may include a first sub-pixel to emit light of a first color, the first sub-pixel including the pixel circuit, the light-emitter, the transistor, and the coupling capacitor; and a second sub-pixel to emit light of a second color different from the first color, the second sub-pixel including a pixel circuit, a light-emitter, and an initialization transistor.

The light-emitter of the first sub-pixel may have a threshold voltage different from the light-emitting device of the second sub-pixel. The coupling capacitance of the coupling capacitor of the first sub-pixel may be different from a coupling capacitance between a node coupled to the second sub-pixel and a control line.

The apparatus may include a plurality of lines connected to the pixel circuit, wherein the plurality of lines include a driving voltage line to carry a first driving voltage, a data line to carry the data signal, a second control line to carry a second control signal, a third control line to carry a third control signal, and a fourth control line to carry a fourth control signal, and wherein the second control signal, the third control signal, and the first control signal have active periods in an inactive period of the fourth control signal.

The pixel circuit may include a driving transistor having a first electrode to receive the first driving voltage and a second electrode connected to the output node; a switching transistor including a first electrode to receive a data signal and a second electrode connected to the first electrode of the driving transistor; a gate initialization transistor to supply the initial voltage to a gate electrode of the driving transistor in response to the second control signal; a compensation transistor to connect the gate electrode of the driving transistor to the second electrode of the driving transistor based on the third control signal; a light-emitting control transistor to output the driving current to the node based on the fourth control signal; and a storage capacitor to store a voltage difference between the first driving voltage and a voltage of the gate electrode of the driving transistor, wherein the driving transistor is to supply a driving current corresponding to the data signal to the light-emitter based on a switching operation of the switching transistor.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
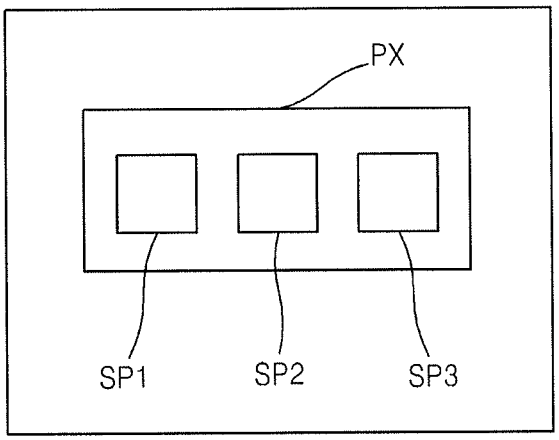
FIG. 1 illustrates an embodiment of an organic light emitting display.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

FIG. 1 illustrates an embodiment of an organic light-emitting display which includes a plurality of pixels PX, each of which includes a first sub-pixel SP1, a second sub-pixel SP2, and a third sub-pixel SP3. Each sub-pixel SP1, SP2, and SP3 includes a light-emitting device to emit light of a predetermined color, e.g., one selected from red R, green G, or blue B. For example, the sub-pixels SP1, SP2, and SP3 emit red R, green G, and blue B light, respectively. The organic light-emitting display apparatus may optionally include another sub-pixel having a light-emitting device to emit light of another color, e.g., white or yellow.

Figure 2:
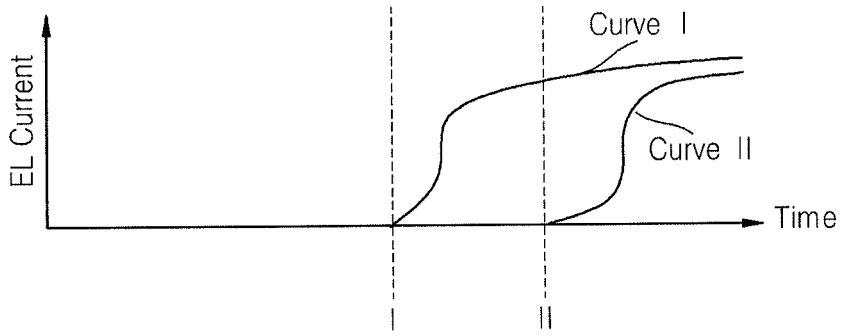
FIG. 2 illustrates an example of a difference in a light-emitting time points between sub-pixels.

FIG. 2 is a graph illustrating an example of a difference in a light-emitting time points between sub-pixels which emit different colors of light. In this graph, the vertical axis corresponds to the amount of driving current for the sub-pixels. The horizontal axis correspond to time. In this case, first and second sub-pixels may have a same structure. Curve I shows the current flowing through the light-emitting device of the first sub-pixel, and Curve II shows the current flowing through the light-emitting device of the second sub-pixel.

Referring to FIG. 2, the first sub-pixel starts to emit light at a time point I corresponding to Curve I, and the second sub-pixel starts to emit light at a time point II corresponding to Curve II. Such a phenomenon may not occur in sub-pixels which emit light of the same color. However, the light-emitting time points are different in the case of FIG. 2 for sub-pixels that emit light of different colors.

Such a phenomenon occurs because characteristics of materials of the light-emitting devices forming the organic light-emitting display apparatus differ. The first light-emitting device of the first sub-pixel includes a first light-emitting material emitting light of a first color. The second light-emitting device of the second sub-pixel includes a second light-emitting material emitting light of a second color. The first and second light-emitting materials have different characteristics, e.g., different size threshold voltages, different light-emitting efficiencies, etc.

For example, the level of the threshold voltage of the first light-emitting device may be different from that of a threshold voltage of the second light-emitting device. The light-emitting efficiency of the first light-emitting device may be different from the second light-emitting device. In addition, the first light-emitting device and the second light-emitting device may have different capacitances according to sizes and manufacturing processes of the first and second light-emitting devices.

For example, when the level of the threshold voltage of the first light-emitting device is lower than the threshold voltage of the second light-emitting device, the light-emitting time point of the first light-emitting device may precede that of the second light-emitting device.

In addition, because light-emitting efficiencies of light-emitting materials are different, the sizes of driving currents of the light-emitting devices may also be different. That is, when a light-emitting efficiency is relatively high, the size of a driving current may be lowered because the same amount of light may be generated by a relatively small amount of current. For example, the light-emitting efficiency of the first light-emitting device may be lower than the second light-emitting device. In this case, the size of the driving current of the first light-emitting device may be larger than the driving current of the second light-emitting device. If a capacitance of the first light-emitting device is substantially equal to that of the second light-emitting device, the time required for the second light-emitting device to charge up to a threshold voltage by the driving voltage may be relatively long compared to the first light-emitting device.

In this respect, Curve II may correspond to a sub-pixel which includes a light-emitting material having a relatively high threshold voltage, or a sub-pixel including a light-emitting material having a relatively high light-emitting efficiency. On the contrary, Curve I may correspond to a sub-pixel including a light-emitting material having a relatively low threshold voltage, or a sub-pixel including a light-emitting material having a relatively low light-emitting efficiency.

As illustrated in FIG. 2, when the light-emitting time point of a sub-pixel (e.g., the first sub-pixel) emitting light of a color (e.g., the first color) precedes a light-emitting time point of a sub-pixel (e.g., the second sub-pixel) emitting light of another color (e.g., the second color), the light of the other color may be insufficient. Thus, a color spreading phenomenon may occur.

Figure 3:
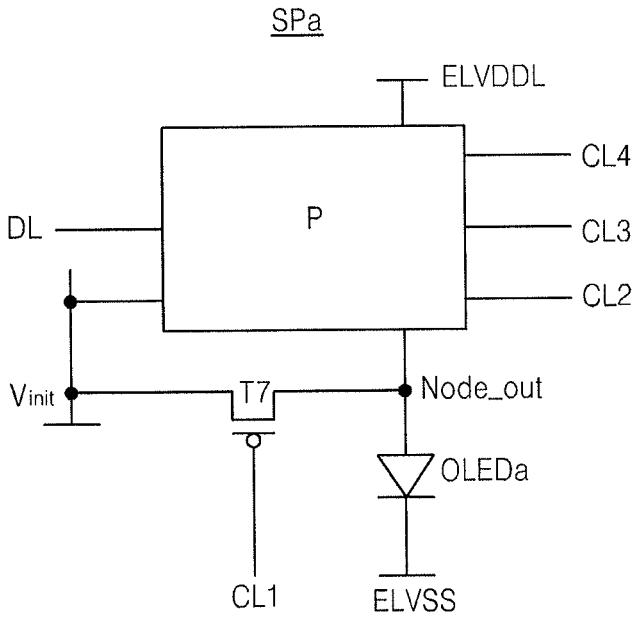
FIGS. 3 and 4 illustrate examples of sub-pixels.
Figure 4:
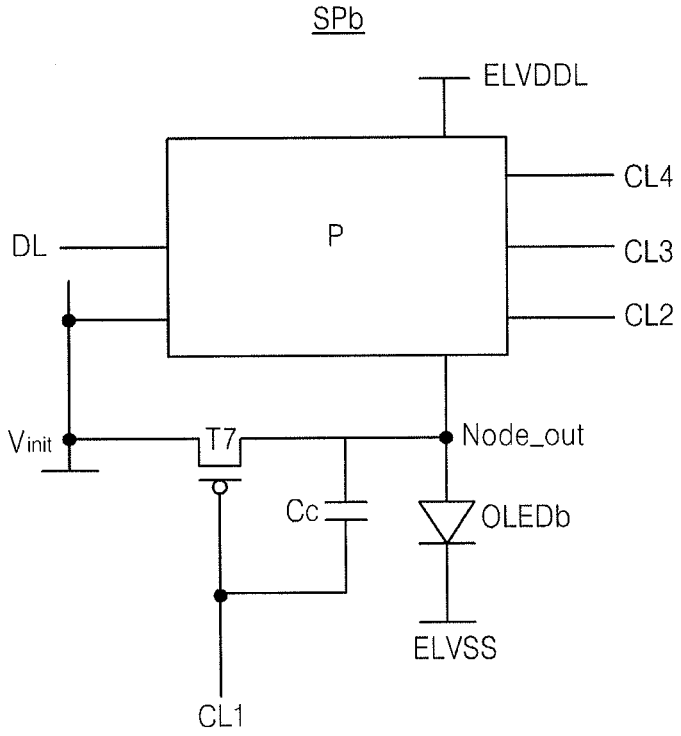

FIGS. 3 and 4 are examples of circuit diagrams of a sub-pixel of the organic light-emitting display apparatus in FIG. 1. FIGS. 3 and 4 may be circuit diagrams of any one of the sub-pixels in FIG. 1. A sub-pixel corresponding to the circuit diagram of FIG. 3 is referred to as a first sub-pixel SPa, and a sub-pixel corresponding to the circuit diagram of FIG. 4 is referred to as a second sub-pixel SPb.

Each of the first and second sub-pixels SPa and SPb includes a pixel circuit P that receives a data signal and outputs a driving current corresponding to the received data signal. The driving current is output to an output node Node_out, coupled to a light-emitting device OLED that emits light based on the driving current input to the output node Node_out. An anode initialization transistor T7 outputs an initial voltage Vinit to the output node Node_out in response to a first control signal received through a first control line CL1.

The pixel circuit P includes a plurality of lines which include, for example, a driving voltage line ELVDDL carrying a first driving voltage, a data line DL carrying the data signal, a second control line CL2 carrying a second control signal, a third control line CL3 carrying a third control signal, and a fourth control line CL4 carrying a fourth control signal. An initial voltage Vinit may be applied to the pixel circuit P in response to the second control signal received through the second control line CL2.

The second control signal, the third control signal, and the first control signal each may sequentially have an active period within an inactive period of the fourth control signal. The active period is a turn-on period for a transistor to which a corresponding signal is applied. When a PMOS transistor is used, the active period may be a period in which the corresponding signal has a low level. On the contrary, the inactive period denotes a period in which a transistor to which a corresponding signal is applied is turned off. When a PMOS transistor is used, the inactive period denotes a period in which the corresponding signal has a high level.

Referring to FIG. 3, the pixel circuit P of the first sub-pixel SPa is coupled to the output node Node_out, the anode initialization transistor T7 initializing an anode voltage, and a first light-emitting device OLEDa having a first light-emitting material. The anode initialization transistor T7 and the first light-emitting device OLEDa are connected to each other through the output node Node_out. The anode initialization transistor T7 is controlled by the first control signal from the first control line CL1. When the anode initialization transistor T7 is turned on, the initial voltage Vinit is applied to the first light-emitting device OLEDa, and thus an anode voltage Vanode is initialized. A second driving voltage ELVSS is applied to a cathode electrode of the first light-emitting device OLEDa. The second driving voltage ELVSS may be a reference potential, e.g., ground voltage.

Referring to FIG. 4, the pixel circuit P of the second sub-pixel SPb includes output node Node_out, an anode initialization transistor T7 initializing an anode voltage, a second light-emitting device OLEDb having a second light-emitting material, and a coupling capacitor Cc. The pixel circuit P and the anode initialization transistor T7 of the second sub-pixel SPb may be substantially the same as the pixel circuit P and the anode initialization transistor T7 of the first sub-pixel SPa. The second light-emitting device OLEDb includes the second light-emitting material.

The second light-emitting material may have a relatively high threshold voltage and a relatively high light-emitting efficiency compared to the first light-emitting material. For example, under the same conditions, the light-emitting time point of the first light-emitting device OLEDa may precede that of the second light-emitting device OLEDb.

The coupling capacitor Cc is connected between the first control line CL1 and the output node Node_out, and serves to raise the anode voltage Vanode of the second light-emitting device OLEDb in response to a rising edge of the first control signal supplied through the first control line CL1.

In the first sub-pixel SPa and the second sub-pixel SPb, the initial voltage Vinit is applied to the output node Node_out when the anode initialization transistor T7 is turned on. The anode initialization transistor T7 is turned on during a portion of a non-light-emitting period, in which the first and second light-emitting devices OLEDa and OLEDb do not emit light. As the turned-on anode initialization transistor T7 lowers the electric potential of the anode electrode of the first light-emitting device OLEDa (or the second light-emitting device OLEDb) to an initial voltage level that is lower than the threshold voltage of the first light-emitting device OLEDa (or the second light-emitting device OLEDb), it may be possible to prevent a phenomenon where the first light-emitting device OLEDa (or the second light-emitting device OLEDb) slightly emits light due to leakage current of the pixel circuit P, potential fluctuation by peripheral control signals, and the like, when a data signal corresponding to black is applied.

The organic light-emitting display according to the present embodiment may include the first sub-pixel SPa and the second sub-pixel SPb. The second sub-pixel SPb includes the coupling capacitor Cc, unlike the first sub-pixel SPa. The second light-emitting device OLEDb of the second sub-pixel SPb may have a predetermined threshold voltage, e.g., one higher than the first light-emitting device OLEDa of the first sub-pixel SPa.

Figure 5:
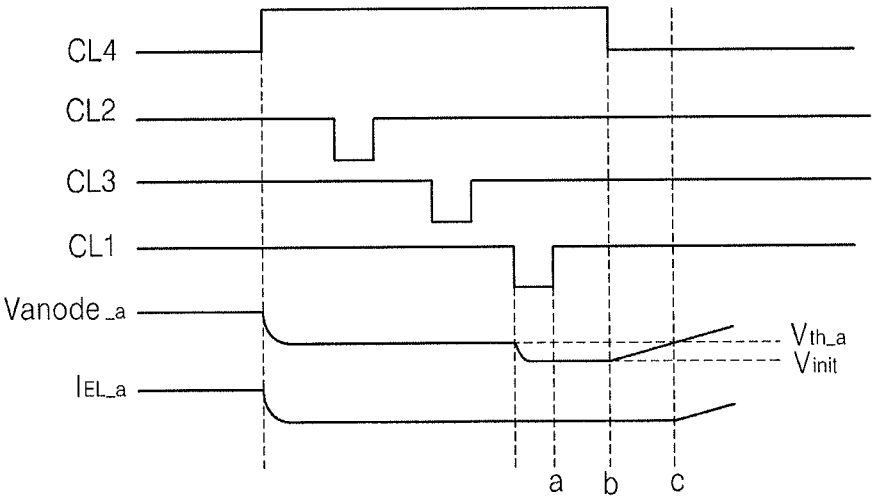
FIG. 5 illustrates an example of control signals for a first sub-pixel.

FIG. 5 is a timing diagram including an example of control signals for operating a first light-emitting device OLEDa of a first sub-pixel, e.g., the first sub-pixel SPa of FIG. 3. The first sub-pixel SPa operates based on control signals received from a plurality of control lines. Second through fourth control lines CL2, CL3, and CL4 in FIG. 5 are described in detail below. The light-emitting device, control line, and control signal in the present embodiment may be, for example, a light-emitting diode, scan line, and scan signal, respectively.

In addition, the output node Node_out and the anode of the light-emitting device OLED may denote substantially the same node. The first sub-pixel SPa and the second sub-pixel SPb may emit light of different colors.

When the level of a fourth control signal supplied through the fourth control line CL4 changes to a high level, the anode voltage Vanode_a of the first light-emitting device OLEDa of the first sub-pixel SPa lowers to the level of a threshold voltage Vth_a.

When the level of a first control signal supplied through the first control line CL1 changes to a low level, the anode voltage Vanode_a of the first light-emitting device OLEDa lowers to the level of an initial voltage Vinit.

When the level of the fourth control signal changes to a low level, the anode voltage Vanode_a exceeds a threshold voltage at a certain time c by a driving current supplied from the pixel circuit P and the first light-emitting device OLEDa starts to emit light.

Figure 6:
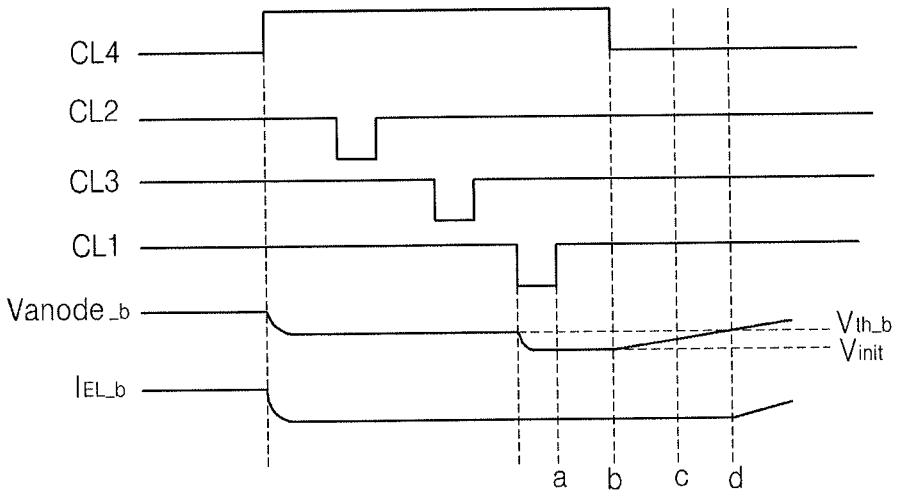
FIG. 6 illustrates an example of control signals for a second sub-pixel.

FIG. 6 is a timing diagram including an example of control signals for operating a second light-emitting device OLEDb of a second sub-pixel, e.g., the second sub-pixel SPb in FIG. 4, instead of the first light-emitting device OLEDa connected to the output node Node_out of the first sub-pixel SPa in FIG. 3. As illustrated in FIG. 6, the first through fourth control signals are supplied through the first through fourth control lines CL1, CL2, CL3, and CL4, respectively, at a timing that is the same as in FIG. 5.

The second light-emitting device OLEDb has a relatively high threshold voltage and/or a relatively high light-emitting efficiency compared to the first light-emitting device OLEDa. Accordingly, in FIG. 6, in the case where the second light-emitting device OLEDb is connected to the output node Node_out of the first sub-pixel SPa of FIG. 3, the second light-emitting device OLEDb emits light at a time point d that lags behind a time point c at which the first light-emitting device OLEDa emits light in the first sub-pixel SPa.

Such a phenomenon occurs because the level of threshold voltage and/or the size of light-emitting efficiency vary according to the types of light-emitting materials, and the size of driving current varies due to a difference in light-emitting efficiency. As the light-emitting time points of the first and second light-emitting devices OLEDa and OLEDb are changed, a color spreading phenomenon may occur.

For example, if the color of light emitted by the second light-emitting device OLEDb is green, the green color may be insufficient in a white screen when the white screen is scrolled. Thus, a color spreading phenomenon in which the green color is seen as purple may occur.

Referring to FIGS. 5 and 6, the first through fourth control signals CL1, CL2, CL3, and CL4 are applied to the pixel circuit P. The second control signal CL2, the third control signal CL3, and the first control signal CL1 may be sequentially activated in a non-active period of the fourth control signal CL4. For example, the second control signal CL2, the third control signal CL3, and the first control signal CL1 may sequentially transition to a low level in a period in which the fourth control signal CL4 is at a high level. This operation is described below with reference to one embodiment of the pixel circuit P.

Figure 7:
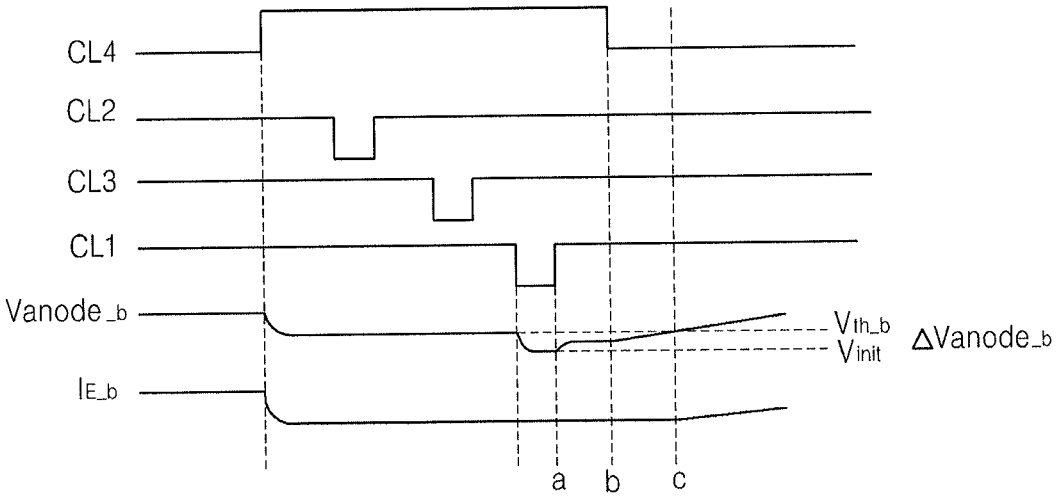
FIG. 7 illustrates another example of control signals for a second sub-pixel.

FIG. 7 is a timing diagram including an example of control signals for a second sub-pixel, e.g., the second sub-pixel SPb of FIG. 4. As described above with reference to FIG. 4, the second sub-pixel SPb includes the coupling capacitor Cc connected between the first control line CL1 and the output node Node_out, compared to the first sub-pixel SPa. Also, the second sub-pixel SPb includes the second light-emitting device OLEDb which has different characteristics from the first light-emitting device OLEDa of the first sub-pixel SPa.

Referring to FIG. 7, the anode voltage Vanode_b drops to the level of an initial voltage Vinit in synchronization with a falling edge of a first control signal supplied through the first control line CL1. The anode initialization transistor T7 is turned on in response to a falling edge of the first control signal, and the initial voltage Vinit is applied to the output node Node_out. The electric potential of the anode electrode (e.g., the anode voltage Vanode_b) of the second light-emitting device OLEDb, which is connected to the output node Node_out, drops from the level of a threshold voltage Vth_b of the second light-emitting device OLEDb to the level of the initial voltage Vinit.

Then, the anode voltage Vanode_b rises in synchronization with a rising edge of the first control signal. As described above, the coupling capacitor Cc is connected between the first control line CL1 and the output node Node_out. As a result, when the electric potential of the first control line CL1 varies, the electric potential of the output node Node_out also varies by the coupling capacitor Cc. Accordingly, when the first control signal transmitted through the first control line CL1 transitions from a low level to a high level, the electric potential of the output node Node_out also rises by the coupling capacitor Cc.

Next, when the level of the fourth control signal supplied through the fourth control line CL4 changes to a low level, the anode voltage Vanode_b slowly rises and then exceeds the threshold voltage Vth_b of the second light-emittng device OLEDb at a time point c. Thus, the second light-emitting device OLEDb starts to emit light. The size of the coupling capacitor Cc may be determined so that the second light-emitting device OLEDb starts to emit light at the time point c.

Accordingly, the light-emitting time point may be adjusted by adding the coupling capacitor Cc to a sub-pixel (e.g., the second sub-pixel SPb) of which a light-emitting time point lags, compared to a sub-pixel for another color (e.g., the first sub-pixel SPa). As in the above-described example, the light-emitting time point may occur earlier. However, when the anode initialization transistor T7 is an N-type MOSFET, the light-emitting time point may be delayed by adding the coupling capacitor Cc.

The amount of change $\Delta V_{anode_b}$ in the anode voltage Vanode_b that rises in synchronization with a rising edge of the initialization control signal is determined by the coupling capacitor Cc and the total capacitance of the anode electrode of the second light-emitting device OLEDb. The total capacitance of the anode electrode of the second light-emitting device OLEDb is mainly determined by an internal capacitance CEL of the second light-emitting device OLEDb. The amount of change $\Delta V_{anode_b}$ in the anode voltage Vanode_b is proportional to a capacitance value of the coupling capacitor Cc. Accordingly, in the organic light-emitting display apparatus according to the present embodiment, the light-emitting time point of the second light-emitting device OLEDb may be adjusted by adjusting the capacitance value of the coupling capacitor Cc.

Figure 8:
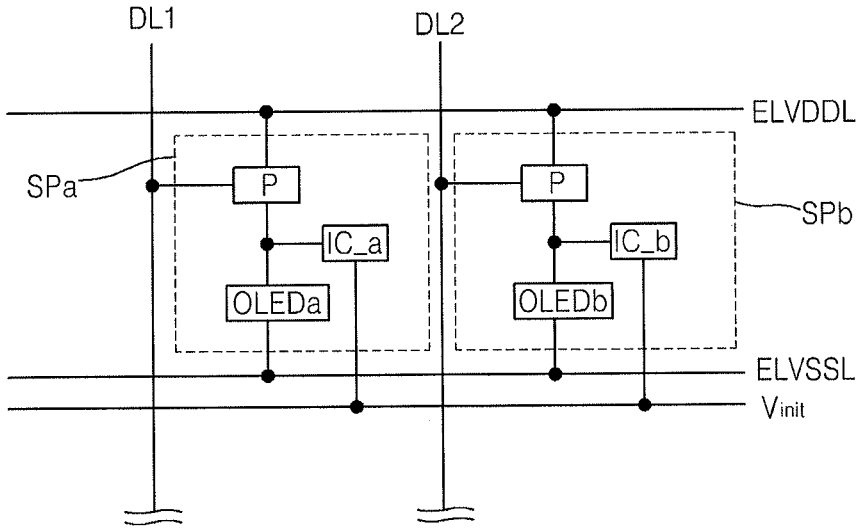
FIG. 8 illustrates another embodiment of a display panel.

FIG. 8 illustrates another embodiment of a display panel including a plurality of sub-pixels. Referring to FIG. 8, the plurality of sub-pixels of the display panel may include a first sub-pixel SPa and a second sub-pixel SPb. Data lines DL1 and DL2 are connected to the first and second sub-pixel SPa and SPb, respectively. A first driving voltage line ELVDDL, a second driving voltage line ELVSSL, and an initialization voltage (Vinit) line may be applied to the first and second sub-pixels SPa and SPb.

The first sub-pixel SPa includes a pixel circuit P, a first light-emitting device OLEDa, and a first initialization circuit IC_a. The second sub-pixel SPa includes a pixel circuit P, a second light-emitting device OLEDb, and a second initialization circuit IC_b. In the first sub-pixel SPa, the pixel circuit P, the first light-emitting device OLEDa, and the first initialization circuit IC_a may be connected to one another through an output node. In the second sub-pixel SPb, the pixel circuit P, the second light-emitting device OLEDb, and the second initialization circuit IC_b may be connected to one another through an output node.

As described above with reference to FIGS. 3 and 4, the first initialization circuit IC_a may include an anode initialization transistor T7, and the second initialization circuit IC_b may include a coupling capacitor Cc in addition to an anode initialization transistor T7.

Figure 9:
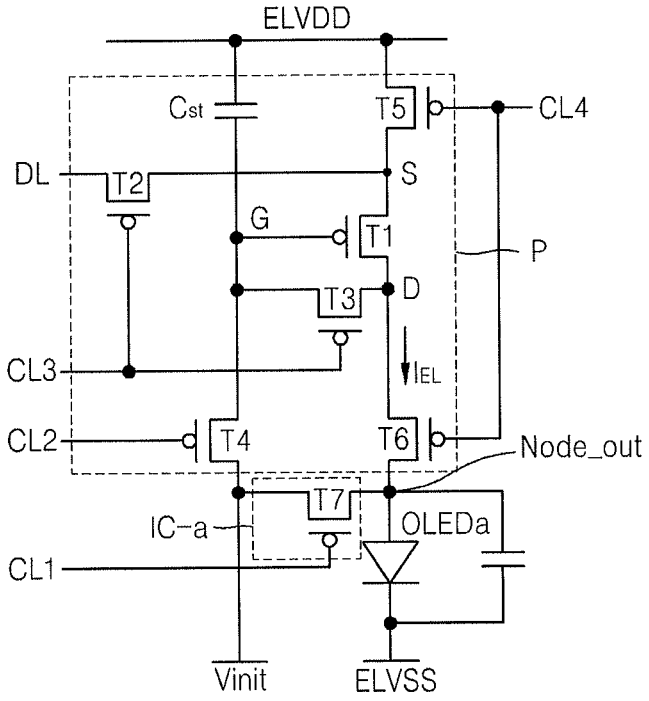
FIG. 9 illustrates another example of a first sub-pixel.

FIG. 9 illustrates another embodiment of a first sub-pixel SPa which includes a pixel circuit P, a first light-emitting device OLEDa, and a first initialization circuit IC_a. The first driving voltage ELVDD is supplied to the pixel circuit P. A data line DL, a second control line CL2, a third control line CL3, and a fourth control line CL4 are connected to the pixel circuit P. A data signal, a second control signal, a third control signal, and a fourth control signal may be supplied to the pixel circuit P through the data line DL, the second control line CL2, the third control line CL3, and the fourth control line CL4, respectively.

The pixel circuit P includes a driving transistor T1, a switching transistor T2, a compensation transistor T3, a gate initialization transistor T4, light-emitting control transistors T5 and T6, and a storage capacitor Cst.

The first initialization circuit IC_a includes an anode initialization transistor T7. The pixel circuit P, the first initialization circuit IC_a, and the first light-emitting device OLEDa may be connected to one another through an output node Node_out. The pixel circuit P, the initialization circuit IC_a, and the first light-emitting device OLEDa are described in detail below with reference to FIG. 10.

Figure 10:
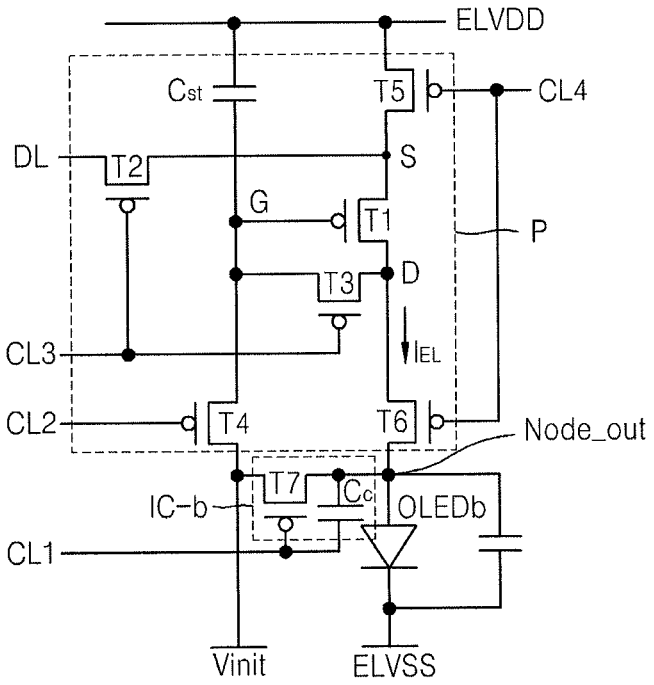
FIG. 10 illustrates another example of a second sub-pixel.

FIG. 10 illustrates a second embodiment of a second sub-pixel SPb including the coupling capacitor Cc. Referring to FIG. 10, the second sub-pixel SPb of this embodiment includes a pixel circuit P, a second light-emitting device OLEDb, and a second initialization circuit IC_b. The first driving voltage ELVDD is supplied to the pixel circuit P. A data line DL, a second control line CL2, a third control line CL3, and a fourth control line CL4 are connected to the pixel circuit P.

A data signal is supplied to the pixel circuit P through the data line DL, a second control signal is supplied to the pixel circuit P through the second control line CL2, a third control signal is supplied to the pixel circuit P through the third control line CL3, and a fourth control signal is supplied to the pixel circuit P through the fourth control line CL4.

As illustrated in FIG. 7, the second control signal and the third control signal may be sequentially supplied to the pixel circuit P through the second control line CL2 and the third control line CL3, respectively.

The pixel circuit P includes a driving transistor T1 and a switching transistor T2. The driving transistor T1 includes a first electrode receiving the first driving voltage ELVDD and a second electrode connected to the second light-emitting device OLEDb. The switching transistor T2 includes a first electrode receiving a data signal and a second electrode connected to the first electrode of the driving transistor T1.

The driving transistor T1 may supply a driving current IEL corresponding to the size of a voltage of the data signal to the second light-emitting device OLEDb according to a switching operation of the switching transistor T2.

The pixel circuit P may further include a gate initialization transistor T4, a compensation transistor T3, light-emitting control transistors T5 and T6, and a storage capacitor Cst. The gate initialization transistor T4 may include a gate electrode connected to the second control line CL2, a first electrode to which an initial voltage Vinit is applied, and a second electrode connected to a gate electrode of the driving transistor T1. The gate initialization transistor T4 may supply the initial voltage Vinit to the gate electrode of the driving transistor T1 in response to the second control signal supplied through the second control line CL2.

The compensation transistor T3 may include a gate electrode connected to the third control line CL3, a first electrode connected to the gate electrode of the driving transistor T1, and a second electrode connected to the second electrode of the driving transistor T1. The compensation transistor T3 may connect the gate electrode of the driving transistor T1 to the second electrode thereof in response to the third control signal supplied through the third control line CL3, so that the driving transistor T1 is placed in a diode-connected state.

The light-emitting control transistors T5 and T6 may include at least one of a first light-emitting control transistor T5, which connects the driving transistor T1 and a line through which the first driving voltage ELVDD is supplied, or a second light-emitting transistor T6 that connects the driving transistor T1 and the second light-emitting device OLEDb. The first light-emitting control transistor T5 may include a gate electrode connected to the fourth control line CL4, a first electrode connected to the line through which the first driving voltage ELVDD is supplied, and a second electrode connected to the first electrode of the driving transistor T1. The second light-emitting control transistor T6 may include a gate electrode connected to the fourth control line CL4, a first electrode connected to the second electrode of the driving transistor T1, and a second electrode connected to an anode electrode of the second light-emitting device OLEDb.

The light-emitting control transistors T5 and T6 may output the driving current IEL to an output node Node_out in response to the fourth control signal supplied through the fourth control line CL4. The first light-emitting control transistor T5 and/or the second light-emitting control transistor T6 are turned on in response to the fourth control signal supplied through the fourth control line CL4. When the first driving voltage ELVDD is applied to the first electrode of the driving transistor T1, the driving current IEL flows to the second light-emitting device OLEDb.

The storage capacitor Cst is connected between the line through which the first driving voltage ELVDD is supplied and a gate node G of the driving transistor T1. A voltage difference between the first driving voltage ELVDD and a voltage of the gate node G of the driving transistor T1 may be stored in the storage capacitor Cst.

The second initialization circuit IC_b includes an anode initialization transistor T7 and the coupling capacitor Cc. A gate electrode of the anode initialization transistor T7 is connected to the first control line CL1, a first electrode of the anode initialization transistor T7 is connected to the anode of the second light-emitting device OLEDb. A second electrode of the anode initialization transistor T7 is connected to a line through which the initial voltage Vinit is supplied. The anode initialization transistor T7 is turned on in response to the first control signal supplied from the first control line CL1, and initializes an anode voltage Vanode_b of the second light-emitting device OLEDb.

The anode voltage Vanode_b of the second light-emitting device OLEDb drops to the level of the initial voltage Vinit in synchronization with a falling edge of the first control signal supplied through the first control line CL1. The anode initialization transistor T7 is turned on in response to a falling edge of the first control signal. The initial voltage Vinit is applied to the output node Node_out. The electric potential of the anode electrode (e.g., the anode voltage Vanode_b) of the second light-emitting device OLEDb, which is connected to the output node Node_out, drops from the level of a threshold voltage of the second light-emitting device OLEDb to the level of the initial voltage Vinit.

Next, the anode voltage Vanode_b rises in synchronization with a rising edge of the first control signal. As described above, the coupling capacitor Cc is connected between the first control line CL1 and the output node Node_out. As a result, when the electric potential of the first control line CL1 varies, the electric potential of the output node Node_out also varies by the coupling capacitor Cc. Accordingly, when the first control signal transmitted through the first control line CL1 transitions from a low level to a high level, the electric potential of the output node Node_out also rises by the coupling capacitor Cc.

Operation of the second sub-pixel SPb is described with reference to FIG. 7. During an initialization period, the second control signal having a low level is supplied through the second control line CL2. Thus, the gate initialization transistor T4 is turned on. The initial voltage Vinit is transferred to the gate electrode of the driving transistor T1 through the gate initialization transistor T4. Thus, a gate voltage of the driving transistor T1 is initialized.

Next, the third control signal having a low level is supplied through the third control line CL3. Thus, the switching transistor T2 and the compensation transistor T3 are turned on. The switching transistor T2 transfers a data signal received through the data line DL to the first electrode of the driving transistor T1. Thus, a compensation voltage VD+Vth (where Vth is a negative value), obtained by subtracting a threshold voltage Vth of the driving transistor T1 from a voltage VD of the data signal, is applied to the gate electrode of the driving transistor T1.

The first driving voltage ELVDD is applied to one terminal of the storage capacitor Cst and the compensation voltage VD+Vth is applied to the other terminal of the storage capacitor Cst. Thus, the storage capacitor Cst is charged with electric charges corresponding to a voltage difference ELVDD−(VD+Vth) between both terminals of the storage capacitor Cst.

Next, when the first control signal having a low level is supplied through the first control line CL1, the anode initialization transistor T7 is turned on and the anode voltage Vanode of the second light-emitting device OLEDb lowers up to the level of the initial voltage Vinit. The voltage of the initialization control signal is applied to one terminal of the coupling capacitor Cc, and the anode voltage Vanode of the second light-emitting device OLEDb is applied to the other terminal of the coupling capacitor Cc. Thus, the coupling capacitor Cc is charged with electric charges corresponding to a voltage difference between both terminals of the coupling capacitor Cc.

When the first control signal having a high level is supplied through the first control line CL1, the anode initialization transistor T7 is turned off and the anode voltage Vanode of the second light-emitting device OLEDb rises in synchronization with a rising edge of the initialization control signal.

Next, during a light-emitting period, the fourth control signal that is supplied from the fourth control line CL4 falls from a high level to a low level and the first light-emitting transistor T5 and the second light-emitting transistor T6 are turned on. The driving current IEL is generated according to a voltage difference between a voltage of the gate electrode of the driving transistor T1 and the first driving voltage ELVDD and is supplied to the second light-emitting device OLEDb through the second light-emitting control transistor T6, and the second light-emitting device OLEDb may emit light by the driving current IEL.

The coupling capacitor Cc may raise the anode voltage Vanode of the second light-emitting device OLEDb before the light-emitting period, to thereby bring a light-emitting time point of the second sub-pixel SPb forward.

By way of summation and review, color spreading occurs when the expression of a specific color of light of pixel, or sub-pixel, is insufficient compared to the expression of another color of light of a pixel, or sub-pixel. For example, the threshold voltage of a light-emitting device of a green sub-pixel may be higher than the light-emitting device of a red or blue sub-pixel.

Also, the amount of driving current of the light-emitting device of the green pixel sub-pixel may be less than the amount of driving current of a light-emitting device of another color sub-pixel. As a result, the time taken until the light-emitting device of the green sub-pixel emits light may be longer than the time taken until the light-emitting device of the red or blue sub-pixel emits light. As a result, a color spreading phenomenon in which the green color is seen as a purple color may occur.

In accordance with one or more embodiments, an organic light-emitting display apparatus is provided in which operation timings of sub-pixels that emit different colors of light may coincide with each other. In accordance with these or other embodiments, a color spreading may be reduced or removed. In one embodiment, the green sub-pixel may be coupled to a capacitor for reducing color spreading.

While one or more embodiments of the present invention have been described with reference to the figures, it will be understood by those of ordinary skill in the art that various changes in form and details may be made therein without departing from the spirit and scope of the present invention as defined by the following claims.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. An organic light-emitting display apparatus, comprising:

a pixel circuit to output a driving current to a node based on a data signal;

a third control line to carry a third control signal;

a light-emitter to emit light based on the driving current at the node;

an initial voltage source providing an initial voltage that is lower than a threshold voltage of the light-emitter;

a transistor having a first electrode that is connected to the initial voltage source, to output the initial voltage to the node which lowers the electric potential at the node to adjust the driving current of the light-emitter, based on a first control signal received through a first control line; and a coupling capacitor coupled to the node and the first control line, wherein the first control line is coupled to a gate electrode of the transistor and wherein the coupling capacitor is directly coupled between the gate electrode and one of the source electrode or the drain electrode of the transistor, wherein the pixel circuit includes:

a driving transistor having a first electrode to receive a first driving voltage, a gate electrode, and a second electrode connected to the node; and a switching transistor having a first electrode to receive the data signal and a second electrode directly connected to the first electrode of the driving transistor, wherein the driving transistor is to supply the driving current corresponding to the data signal to the light-emitter according to a switching operation of the switching transistor, and wherein the third control line is connected to a gate electrode of the switching transistor and the switching operation of the switching transistor is to be performed corresponding to the third control signal received through the third control line.

2. The apparatus as claimed in claim 1, wherein the transistor is to initialize a potential of the node, the potential changing in synchronization with an edge of the first control signal by the coupling capacitor.

3. The apparatus as claimed in claim 1, further comprising:

a first sub-pixel to emit light of a first color, the first sub-pixel including the pixel circuit coupled to the light-emitter, the transistor, and the coupling capacitor; and a second sub-pixel to emit light of a second color different from the first color, the second sub-pixel including an initialization transistor and a pixel circuit coupled to a light-emitter.

4. The apparatus as claimed in claim 3, wherein the light-emitter coupled to the first sub-pixel has a threshold voltage different from the light-emitter coupled to the second sub-pixel.

5. The apparatus as claimed in claim 1, further comprising:

a driving voltage line to carry a first driving voltage, a data line to carry the data signal, a second control line to carry a second control signal, and a fourth control line to carry a fourth control signal, and wherein the second control signal, the third control signal, and the first control signal have active periods in an inactive period of the fourth control signal.

6. The apparatus as claimed in claim 1, wherein the pixel circuit includes:

a gate initialization transistor to supply the initial voltage to a gate electrode of the driving transistor based on the second control signal;

a compensation transistor to connect the gate electrode of the driving transistor to the second electrode of the driving transistor based on the third control signal;

a first light-emitting control transistor to output the driving current to the node based on the fourth control signal; and a storage capacitor to store a voltage difference between the first driving voltage and a voltage of the gate electrode of the driving transistor.

7. The apparatus as claimed in claim 6, wherein the gate initialization transistor includes a gate electrode connected to the second control line, a first electrode to receive the initial voltage, and a second electrode connected to the gate electrode of the driving transistor, wherein the compensation transistor includes a gate electrode connected to the third control line, a first electrode connected to the gate electrode of the driving transistor, and a second electrode connected to the second electrode of the driving transistor, and a second light-emitting control transistor to connect the driving transistor and the driving voltage line, wherein the first light-emitting transistor is to connect the driving transistor to the light-emitter.

8. An organic light-emitting display apparatus, comprising:

a plurality of first sub-pixels, a plurality of second sub-pixels, and a plurality of third sub-pixels, wherein each of the first through third sub-pixels includes:

a pixel circuit to output a driving current to a node based on a data signal;

a third control line to carry a third control signal;

a light-emitter to emit light based on the driving current at the node;

an initial voltage source providing an initial voltage that is lower than a threshold voltage of the light-emitter;

a transistor having a first electrode that is connected to the initial voltage source, to output the initial voltage to the node which lowers the electric potential at the node to adjust the driving current of the light-emitter, based on a first control signal carried through a first control line, wherein the first control line is coupled to a gate electrode of the transistor and wherein at least one of the first through third sub-pixels includes a coupling capacitor coupled to the node and the first control line and directly coupled between the gate electrode and one of the source electrode or the drain electrode of the transistor, and wherein the pixel circuit includes:

a driving transistor having a first electrode to receive a first driving voltage, a gate electrode, and a second electrode connected to the node; and a switching transistor having a first electrode to receive the data signal and a second electrode directly connected to the first electrode of the driving transistor, wherein the driving transistor is to supply the driving current corresponding to the data signal to the light-emitter according to a switching operation of the switching transistor, and wherein the third control line is connected to a gate electrode of the switching transistor and the switching operation of the switching transistor is to be performed corresponding to the third control signal received through the third control line.

9. The apparatus as claimed in claim 8, wherein a potential of the node is initialized based on the initial voltage from the transistor, the potential changing in synchronization with an edge of the first control signal by the coupling capacitor.

10. The apparatus as claimed in claim 8, further comprising:

wherein the plurality of lines include a driving voltage line to carry a first driving voltage, a data line to carry the data signal, a second control line to carry a second control signal, and a fourth control line to carry a fourth control signal, and wherein the second control signal, the third control signal, and the first control signal have active periods in an inactive period of the fourth control signal.

11. The apparatus as claimed in claim 10, wherein the pixel circuit includes:

a gate initialization transistor to supply the initial voltage to a gate electrode of the driving transistor based on the second control signal;

a compensation transistor to connect the gate electrode of the driving transistor to the second electrode of the driving transistor based on the third control signal;

a light-emitting control transistor to output the driving current to the node based on the fourth control signal; and a storage capacitor to store a voltage difference between the first driving voltage and a voltage of the gate electrode of the driving transistor, wherein the driving transistor is to supply a driving current corresponding to the data signal to the light-emitter according to a switching operation of the switching transistor.

12. The apparatus as claimed in claim 8, wherein: the coupling capacitor is coupled to the light-emitter, and the light-emitter emits green light.

13. The apparatus as claimed in claim 3, wherein a coupling capacitance of the coupling capacitor of the first sub-pixel is different from a coupling capacitance between a node coupled to the second sub-pixel and a control line.

14. The apparatus as claimed in claim 1, wherein the coupling capacitor is to store a voltage based on a difference between a potential of the first control line and a potential of the node.

* * * * *